US009809037B2

(12) United States Patent
Yano

(10) Patent No.: US 9,809,037 B2
(45) Date of Patent: Nov. 7, 2017

(54) INK JET RECORDING METHOD AND INK JET RECORDING APPARATUS

(71) Applicant: Seiko Epson Corporation, Tokyo (JP)

(72) Inventor: Takeshi Yano, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/099,703

(22) Filed: Apr. 15, 2016

(65) Prior Publication Data

US 2016/0339719 A1 Nov. 24, 2016

(30) Foreign Application Priority Data

May 21, 2015 (JP) ..... 2015-103973
Jul. 13, 2015 (JP) ..... 2015-139932

(51) Int. Cl.
*B41J 11/00* (2006.01)
*B41M 5/00* (2006.01)

(52) U.S. Cl.
CPC ..... *B41J 11/0015* (2013.01); *B41M 5/0017* (2013.01)

(58) Field of Classification Search
None
See application file for complete search history.

(56) References Cited

U.S. PATENT DOCUMENTS 4,849,773 A * 7/1989 Owatari ..... C09D 11/30 106/31.27
9,114,653 B2 8/2015 Aoyama et al.
2015/0054883 A1* 2/2015 Okuda ..... C09D 11/40 347/20
2015/0328904 A1 11/2015 Yano

FOREIGN PATENT DOCUMENTS

JP 2009-137056 A 6/2009

* cited by examiner

*Primary Examiner* — An Do
*Assistant Examiner* — Renee I Wilson
(74) *Attorney, Agent, or Firm* — Harness, Dickey & Pierce, P.L.C.

(57) ABSTRACT

Provided is an ink jet recording method including: applying a reaction liquid to a recording medium by sending the reaction liquid from a reaction liquid container to a nozzle orifice in an ink jet head through a reaction liquid passage and discharging the reaction liquid from the nozzle orifice, the reaction liquid passage connecting the reaction liquid container to the nozzle orifice; and applying an ink composition to the recording medium by discharging the ink composition from a nozzle orifice in the ink jet head, the ink composition at least containing a color material. The reaction liquid contains a (meth)acrylic resin and a polyvalent metal salt, the polyvalent metal salt serving as a coagulating agent that is reactive with a component of the ink composition. At least one of materials that constitute the reaction liquid container and the reaction liquid passage and that make contact with the reaction liquid contains a C6 or higher aliphatic acid.

11 Claims, 1 Drawing Sheet

INK JET RECORDING METHOD AND INK JET RECORDING APPARATUS

BACKGROUND

1. Technical Field

The present invention relates to an ink jet recording method and an ink jet recording apparatus.

2. Related Art

Ink jet recording methods realize recording of high-resolution images with the use of a relatively simple apparatus and therefore have been advancing rapidly in various fields. Under such circumstances, various studies have been conducted on how to ensure stable liquid discharge and the like. For example, JP-A-2009-137056 discloses a reaction liquid for ink jet recording that is to be used together with color pigment ink and that is reactive upon contact with the color pigment ink. The reaction liquid contains (a) a polyvalent metal salt, (b) a kind of maleic acid, and (c) a liquid medium. An object of JPA-2009-137056 is to provide a reaction liquid for ink jet recording that can be continuously discharged.

However, JP-A-2009-137056 provides no mention that the interaction between the reaction liquid and materials constituting the ink jet recording apparatus may produce impurities which can be a cause of clogging. The reaction liquid containing a polyvalent metal salt dissolves some components of the materials that constitute the ink jet recording apparatus and that make contact with the reaction liquid. Such components, which are dissolved in the reaction liquid, form impurities and this results in clogging. On the other hand, in the case where a monovalent metal salt is used, there is a problem in that recorded images have low quality.

SUMMARY

An advantage of some aspects of the invention is that a reaction liquid which can be discharged smoothly and which achieves high-quality recorded images is provided.

Specifically, some aspects of the invention are as follows.

According to an aspect of the invention, there is provided an ink jet recording method including: applying a reaction liquid to a recording medium by sending the reaction liquid from a reaction liquid container to a nozzle orifice in an ink jet head through a reaction liquid passage and discharging the reaction liquid from the nozzle orifice, the reaction liquid passage connecting the reaction liquid container to the nozzle orifice; and applying an ink composition to the recording medium by discharging the ink composition from a nozzle orifice in the ink jet head, the ink composition containing a color material. The reaction liquid contains a (meth)acrylic resin and a polyvalent metal salt, the polyvalent metal salt serving as a coagulating agent that is reactive with a component of the ink composition. At least one of materials that constitute the reaction liquid container and the reaction liquid passage and that make contact with the reaction liquid contains a C6 or higher aliphatic acid.

It is preferable that the ink jet recording method be arranged such that the aliphatic acid is a C6 to C25 aliphatic acid.

It is preferable that the ink jet recording method be arranged such that the (meth)acrylic resin contains a water-soluble resin.

It is preferable that the ink jet recording method be arranged such that the (meth)acrylic resin is a colorant dispersant for dispersing a colorant in a water-based ink composition.

It is preferable that the ink jet recording method be arranged such that the (meth)acrylic resin is contained in an amount of 0.10 to 20 mass % with respect to the total mass of the reaction liquid.

It is preferable that the ink jet recording method be arranged such that the ratio defined as A/M is 200 or greater, where M is the total amount, in parts by mass, of the aliphatic acid that can be dissolved from the at least one of the materials and A is the total amount, in parts by mass, of the (meth)acrylic resin contained in the reaction liquid in the reaction liquid container and the reaction liquid passage.

It is preferable that the ink jet recording method be arranged such that the polyvalent metal salt is contained in an amount of 0.10 to 10 mass % with respect to the total mass of the reaction liquid.

According to another aspect of the invention, there is provided an ink jet recording apparatus which is configured to perform recording by any of the ink jet recording methods described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
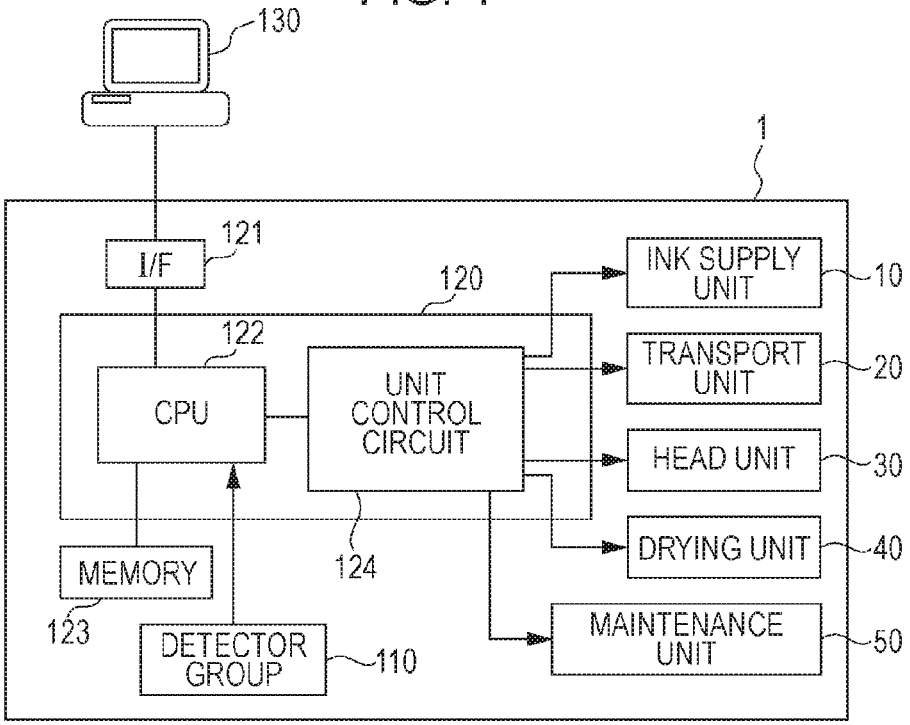
FIG. 1 is a block diagram showing one example of a configuration of a recording apparatus that can be used in the present embodiment.

The following discusses an embodiment of the invention (this embodiment is hereinafter referred to as the present embodiment) in detail with reference to the drawings as needed. It should be noted, however, that the invention is not intended to be limited to this embodiment and may be modified in various ways without departing from the spirit and scope of the invention. It should be noted that the same elements in the drawings are assigned identical reference numbers and are not described repeatedly. The relative positions such as above, below, left, and right in the description are based on the relative positions in the drawings unless otherwise specified in the description. Furthermore, the relative sizes of the elements are not intended to be limited to those illustrated in the drawings. Further note that "(meth)acrylic" in the description can denote both an acrylic and a methacrylic that corresponds to the acrylic.

Ink Jet Recording Method

An ink jet recording method of the present embodiment includes: applying a reaction liquid to a recording medium by sending the reaction liquid from a reaction liquid container to a nozzle orifice in an ink jet head through a reaction liquid passage and discharging the reaction liquid from the nozzle orifice, the reaction liquid passage connecting the reaction liquid container to the nozzle orifice; and applying an ink composition to the recording medium by discharging the ink composition from a nozzle orifice in the ink jet head, the ink composition at least containing a color material. The reaction liquid contains a (meth)acrylic resin and a polyvalent metal salt, the polyvalent metal salt serving as a coagulating agent that is reactive with a component of the ink composition. At least one of materials that constitute the reaction liquid container and the reaction liquid passage and that make contact with the reaction liquid contains a C6 or higher aliphatic acid.

Step of Applying Reaction Liquid

The step of applying a reaction liquid involves applying a reaction liquid to a recording medium by sending the reaction liquid from a reaction liquid container to a nozzle orifice in an ink jet head through a reaction liquid passage and discharging the reaction liquid from the nozzle orifice. The reaction liquid passage connects the reaction liquid container to the nozzle orifice in the ink jet head.

FIG. 1 is a block diagram showing one example of a configuration of a recording apparatus that can be used in the present embodiment. A computer 130 has a printer driver installed and sends print data to a printer 1 to cause the printer 1 to record an image that corresponds to the print data. The printer 1 corresponds to a "recording apparatus". The printer 1 includes an ink supply unit 10, a transport unit 20, a head unit 30, a drying unit 40, a maintenance unit 50, a detector group 110, a memory 123, an interface 121, and a controller 120. The controller 120 includes a CPU 122 and a unit control circuit 124. Upon receiving the print data from the computer 130 which is an external device, the printer 1 adjusts various recording conditions by controlling each unit via the controller 120 and thereby records an image represented by the print data on a recording medium. The conditions in the printer 1 are monitored by the detector group 110. The detector group 110 sends the detection results to the controller 120. The controller 120 controls each unit on the basis of the detection results received from the detector group 110 and stores the print data, which is received via the interface 121, in the memory 123. The memory 123 also stores therein control information for controlling each unit. The drying unit 40 includes a heater, an air blower, and the like, and is configured to dry a composition, such as ink, which has been applied to the recording medium.

Ink Jet Head

The head unit 30 of the recording apparatus (printer 1) includes a head (ink jet head) through which a reaction liquid or an ink composition is discharged toward a recording medium while recording. The head has: a cavity having a nozzle through which a reaction liquid in a reaction liquid container is discharged or an ink composition in an ink composition container is discharged; a discharge actuator that corresponds to the cavity and that is configured to force out the reaction liquid or the ink composition; the nozzle which corresponds to the cavity and through which the reaction liquid or the ink composition is discharged out of the head; and a nozzle face which has the nozzle. The head may have a plurality of separate cavities, a plurality of separate discharge actuators corresponding to the respective cavities, and a plurality of separate nozzles corresponding to the respective cavities. The discharge actuator may be constituted by an electromechanical transducer such as a piezoelectric element that causes a change in volume of the cavity by mechanical deformation, an electrothermal converter that generates heat and causes an air bubble to form in the reaction liquid or the ink composition and thereby discharges the reaction liquid or the ink composition out of the head, or the like. The recording apparatus may have one head per color of ink or may have a plurality of heads per color of ink. In the case where the recording apparatus has a plurality of heads per color of ink, the heads may be arranged along the width of the recording medium to form a line head. This makes it possible to increase a recording width (described later). In the case of recording using a plurality of colors of ink compositions, the recording apparatus includes heads corresponding to the respective colors of ink compositions. Each head may be structured like that illustrated in, for example, FIG. 3 of JP-A-2009-279830.

In the case where the recording apparatus is a line printer (i.e., a line-type recording apparatus), the head thereof is a line head whose nozzle array is equal to or longer than the recording width of the recording medium. The relative positions of the line head and the recording medium are changed in a scanning direction, which intersects the direction of the width of the recording medium, while the ink composition is discharged from the line head toward the recording medium. The line printer is configured such that the head is fixed and does not (almost does not) move and the recording is performed in one pass (single pass). The line printer is more advantageous than a serial printer due to its rapid recording ability.

It should be noted here that the "line head whose nozzle array is equal to or longer than the recording width of the recording medium" is not limited to a line head whose length is exactly equal to the width of the recording medium, and may be a line head whose length is different from the width of the recording medium. An example of such a case is that the length of the line head is equal to the width of a portion of the recording medium which is to receive the ink composition (i.e., a portion where an image is to be recorded) (such a width is referred to as the recording width).

In contrast, a serial printer, which is a serial-type recording apparatus, is configured such that the ink composition is discharged from the head while the head is travelling in the main scanning direction intersecting the subscanning direction of the recording medium (this travelling movement is main scanning, i.e., a pass) and recording is performed in, usually, two or more passes (multiple passes).

Reaction Liquid Container

A "reaction liquid container" denotes the container that directly contains a reaction liquid. Examples of the reaction liquid container include, but are not limited to, reaction liquid cartridges, reaction liquid packs, reaction liquid bottles, and reaction liquid tanks. Of these, packs are preferred.

The way in which the container may be used is not particularly limited. Examples include: (A) a cartridge or the like which is separate from the recording apparatus and which is attached to the recording apparatus so that the ink composition is supplied from the attached cartridge to the recording apparatus; (B) an ink tank or the like which is separate from the recording apparatus and from which the reaction liquid is supplied to the recording apparatus; and (C) a container which is preinstalled in the recording apparatus. It should be noted that, when recording is performed in each case, the ink composition may be supplied from the attached reaction liquid container to the head of the recording apparatus through a connector such as an ink tube.

Reaction Liquid Passage

A "reaction liquid passage" in an ink jet recording apparatus denotes a passage through which the reaction liquid passes. Examples of the reaction liquid passage include: a reaction liquid supply passage through which the reaction liquid is supplied to the ink jet head from the reaction liquid container containing the reaction liquid; and a channel in an ink jet head through which the reaction liquid passes through to a nozzle orifice.

C6 or Higher Aliphatic Acid

At least one of the materials that constitute the reaction liquid container and the reaction liquid passage and that make contact with the reaction liquid contains a C6 or higher aliphatic acid. At least one of the materials that constitute the reaction liquid container and the reaction liquid passage and that make contact with the reaction liquid, which contains a C6 or higher aliphatic acid, hereinafter may be referred to as an "aliphatic-acid-containing material" for short. A material that constitutes the reaction liquid container and that makes contact with the reaction liquid is not particularly limited. Examples include materials constituting the inside wall of a pack and the exit of the pack through which the reaction liquid exits. A material that constitutes the reaction liquid passage and that makes contact with the reaction liquid is not particularly limited. Examples include: a material constituting the inside wall of an ink tube (ink composition supply passage); a material constituting the inside wall of an ink jet head; and a material constituting the inside wall of a connector connecting the ink tube and the ink jet head to each other.

The C6 or higher aliphatic acid is not particularly limited. Examples include hexanoic acid, enanthic acid, caprylic acid, pelargonic acid, capric acid, lauric acid, myristic acid, pentadecylic acid, palmitic acid, palmitoleic acid, margaric acid, oleic acid, linoleic acid, linolenic acid, arachidic acid, and stearic acid. Of these, stearic acid is preferred.

The number of carbons in the aliphatic acid is 6 or more, more preferably 10 or more. The upper limit is more preferably 25 or less, even more preferably 20 or less. Aliphatic acids having such a number of carbons are preferable because materials containing such aliphatic acids are, for example, readily available commercially and durable.

The ratio (A/M) of the total mass A (parts by mass) of the meth(acrylic) resin contained in the reaction liquid in the reaction liquid container and the reaction liquid passage to the total dissolution amount M (parts by mass) of the aliphatic acid that can be dissolved from the aliphatic-acid-containing material is preferably 0.1 or greater, more preferably 2.0 or greater, even more preferably 200 or greater, yet more preferably 500 or greater, particularly preferably 1000 or greater. The upper limit is not limited, but is preferably 50000000 or less, more preferably 100000 or less, even more preferably 10000 or less.

The total dissolution amount M is the total amount of the aliphatic acid that can be dissolved from the entire aliphatic-acid-containing material. The total dissolution amount M is calculated in the following manner. First, each material that constitutes a recording apparatus and that makes contact with a reaction liquid is prepared as a test piece having a surface area of 120 $cm^2$. Each test piece is attached to the inside of a glass container. Next, a test reaction liquid is prepared by mixing solid calcium acetate (2 mass %), propylene glycol (20 mass %), and water (up to 100 mass %). An amount of 50 ml of the test reaction liquid is put into the glass container until the surface of the material is totally wet with the liquid, and the container is hermetically closed with a lid. Then, the test reaction liquid is left to stand at 70° C. for 6 days. Next, the test reaction liquid is removed from the glass container, and the amount of the aliphatic acid contained in the test reaction liquid is measured to determine the amount of the C6 or higher aliphatic acid in the test reaction liquid. The obtained amount (mass, g) of the aliphatic acid is divided by the surface area (120 $cm^2$) of the material. The obtained value is the dissolution amount B ($g/cm^2$) of the C6 or higher aliphatic acid per surface area (1 $cm^2$) for the corresponding material.

The amount of the aliphatic acid in the test reaction liquid is measured in the following manner. An amount of 50 ml of the test reaction liquid after having been left to stand is passed through a filter (10 μm mesh), and the amount of the C6 or higher aliphatic acid remaining on the filter is analyzed. The amount of the C6 or higher aliphatic acid is analyzed by a known method.

Next, the total area S, of contact with the reaction liquid, of each material is calculated. The total dissolution amount M can be calculated from the dissolution amount B and the total area S using the following equation. When two or more materials are used, the following equation is used; however, needless to say, when the number of materials containing the C6 or higher aliphatic acid is one, the "$B_2 \times S_2$" and subsequent terms are zero.

$$\text{Total dissolution amount } M = B_1 \times S_1 + B_2 \times S_2 + B_3 \times S_3 \ldots$$

where 1, 2, and 3 each denote the type of material, $B_1$ represents the dissolution amount ($g/cm^2$) of the aliphatic acid dissolved from Material 1, and $S_1$ represents the total area, of contact with the reaction liquid, of Material 1 of the recording apparatus.

It should be noted that the dissolution amount B calculated here is the dissolution amount B of each material at the surface that makes contact with the reaction liquid. Specifically, in the case where the reaction liquid container is a pack, the dissolution amount B is the amount of the aliphatic acid dissolved from the inside surface of a film constituting the pack. In the case where the reaction liquid passage is a tube, the dissolution amount B is the amount of the aliphatic acid dissolved from the inside surface of the tube.

The total mass A is the total mass of the (meth)acrylic resin contained in the reaction liquid in the reaction liquid container and the reaction liquid passage. The total mass A can be calculated in the following manner. First, the maximum amount Y (g) of the reaction liquid that can be contained in the reaction liquid container and the reaction liquid passage of the recording apparatus is calculated. Next, the percentage C (wt %) of the (meth)acrylic resin contained in the reaction liquid is calculated. Then, the total mass A can be calculated using the following equation.

$$\text{Total mass } A = Y \times C \times 0.01$$

Reaction Liquid

The reaction liquid contains a (meth)acrylic resin and a polyvalent metal salt. The polyvalent metal salt serves as a coagulating agent that causes coagulation of components of the ink composition.

(Meth)Acrylic Resin

The (meth)acrylic resin is not particularly limited. Examples include polymers and copolymers containing (meth)acrylic acids or (meth)acrylic esters as units. Of these, polymers and copolymers containing (meth)acrylic acids as units are preferred. More specific examples include, but are not limited to, polyacrylic acids, acrylic acid-acrylonitrile copolymers, acrylic acid-acrylic ester copolymers, styrene-acrylic acid copolymers, styrene-α-methylstyrene-acrylic acid copolymers, styrene-α-methylstyrene-acrylic acid-acrylic ester copolymers, vinylnaphthalene-acrylic acid copolymers, vinyl acetate-acrylic acid copolymers, and the like, and salts thereof. Copolymers may be random copolymers, block copolymers, alternating copolymers, or graft copolymers.

Examples of salts of (meth)acrylic resins include salts of a (meth)acrylic resin and a basic compound such as ammonia, ethylamine, diethylamine, triethylamine, propylamine, isopropylamine, dipropylamine, butylamine, isobutylamine, diethanolamine, triethanolamine, tri-iso-propanolamine, aminomethyl propanol, morpholine, or the like. The amounts of these basic compounds are not particularly limited, but are preferably equal to or larger than the neutralization equivalent of the above-described resin.

The amount of the (meth)acrylic acid unit or the (meth) acrylic ester unit is preferably 40 mass % or more and 100 mass % or less, more preferably 50 mass % or more and 100 mass % or less, even more preferably 70 mass % or more and 100 mass % or less, particularly preferably 90 mass % or more and 100 mass % or less, with respect to the total amount of the (meth)acrylic resin. The amount falling within this range tends to achieve better quality images, even better discharge performance, and the like.

Of the (meth)acrylic resins listed above, water-soluble resins (solvent-based resins) are preferable in terms of good discharge performance and the like. Such a (meth)acrylic resin tends to achieve even better discharge performance. It should be noted here that the term "water-soluble resin" denotes a resin which, when dissolved in water to give a 5 mass % aqueous solution, does not appear cloudy or does not generate any visible impurities at 25° C.

Examples other than the water-soluble resins include resin dispersions such as emulsion-type resins.

It is more preferable that the (meth)acrylic resin be a colorant dispersant for dispersing colorants of water-based ink compositions. The colorant dispersant for dispersing colorants of water-based ink compositions is not particularly limited. Examples include polyacrylic acids, acrylic acid-acrylonitrile copolymers, acrylic acid-acrylic ester copolymers, styrene-acrylic acid copolymers, styrene-α-methylstyrene-acrylic acid copolymers, styrene-α-methylstyrene-acrylic acid-acrylic ester copolymers, vinylnaphthalene-acrylic acid copolymers, vinyl acetate-acrylic acid copolymers, and the like, and salts thereof.

The amount of the (meth)acrylic resin is preferably 0.05 to 35 mass % with respect to the total mass of the reaction liquid. The upper limit is preferably 30 mass % or less, more preferably 20 mass % or less, even more preferably 10 mass % or less. The lower limit is preferably 0.10 mass % or more.

Polyvalent Metal Salt

A polyvalent metal salt serves as a coagulating agent that causes coagulation of components of the ink composition. Such a polyvalent metal salt is not particularly limited. Preferred examples include polyvalent metal salts of inorganic acids and polyvalent metal salts of organic acids. Such a polyvalent metal salt is not particularly limited. Examples include salts of alkaline earth metals (e.g., magnesium, calcium) in the second group of the periodic table, transition metals (e.g., lanthanum) in the third group of the periodic table, earth metals (e.g., aluminum) in the thirteenth group of the periodic table, and lanthanides (e.g., neodymium). Of these polyvalent metal salts, carboxylates (e.g., salts of formic acid, acetic acid, benzoic acid), sulfates, nitrates, chlorides, and thiocyanates are preferred. Preferred of these are, for example: calcium salts or magnesium salts of carboxylic acids (e.g., formic acid, acetic acid, benzoic acid); calcium salts or magnesium salts of sulfuric acid; calcium salts or magnesium salts of nitric acid; calcium chloride; magnesium chloride; and calcium salts or magnesium salts of thiocyanic acid. The above-listed polyvalent metals and acids, which are constituents of polyvalent metal salts, may be used in any combination, or may be hydrates. It should be noted that a single polyvalent metal salt may be used or two or more polyvalent metal salts may be used in combination.

Monovalent metal salts generate few impurities but tend to reduce the quality of recorded images.

The amount of the polyvalent metal salt is preferably 0.10 to 35.0 mass % with respect to the total mass (100 mass %) of the reaction liquid. The lower limit is preferably 0.50 mass % or more, more preferably 1.0 mass % or more. The upper limit is preferably 30.0 mass % or less, more preferably 25.0 mass % or less, even more preferably 20.0 mass % or less, yet more preferably 10.0 mass % or less, particularly preferably 7.5 mass % or less. The polyvalent metal salt in an amount falling within this range tends to achieve high-quality recorded images and, when the reaction liquid makes contact with the aliphatic-acid-containing material, generate few impurities which result from the reaction with the dissolved aliphatic acid.

The reaction liquid may contain other components if needed. Such other components are not particularly limited. Examples include organic solvents.

Humectant

A humectant is not particularly limited. Examples include: hydrocarbon solvents such as toluene, hexane, cyclohexane, benzene, octane, and isooctane; ester solvents such as ethyl acetate, butyl acetate, and γ-butyrolactone; ketone solvents such as acetone, methyl ethyl ketone, methyl isobutyl ketone, and cyclohexanone; alcohol solvents such as methanol, ethanol, propanol, isopropanol, butanol, glycerol, propylene glycol, triethylene glycol, and triethylene glycol monobutyl ether; halogen solvents such as dichloroethane, and chloroform; ether solvents such as diethyl ether and tetrahydrofuran; amide solvents such as N,N-dimethylformamide, N,N-dimethylacetamide, N-methyl-2-pyrrolidone, N-ethyl-2-pyrrolidone, 2-pyrrolidone, N-methyl-ε-caprolactam, and hexamethylphosphoramide; and other water-soluble organic solvents.

The total amount of the humectant with respect to the total amount of the reaction liquid is preferably 5.0 to 35.0 mass %. The lower limit is preferably 10.0 mass % or more, more preferably 15.0 mass % or more. The upper limit is preferably 30.0 mass % or less, more preferably 25.0 mass % or less.

Water-Soluble Organic Solvent

The reaction liquid may contain an organic solvent. Examples of the organic solvent include the above-listed humectants and organic solvents for use as penetrants. Examples of organic solvents other than humectants include alkanediols and glycol ethers. Preferred alkanediols are C3 to C8 alkanediols. More preferred is 1,2-alkanediol. Preferred glycol ethers are C3 to C12 glycol ethers. More preferred is glycol monoether. The reaction liquid containing an organic solvent is preferable in terms of stable discharging of the reaction liquid. However, the reaction liquid containing an organic solvent tends to readily dissolve the C6 or higher aliphatic acid from the aliphatic-acid-containing material. Therefore, the present embodiment is particularly advantageous.

The total amount of organic solvents, including a humectant, is preferably 1.0 to 40 mass % with respect to the total mass of the reaction liquid. The lower limit is preferably 5.0 mass % or more, more preferably 15.0 mass % or more. The upper limit is preferably 30.0 mass % or less, more preferably 25.0 mass % or less.

Step of Applying Ink Composition

The step of applying an ink composition involves applying the ink composition, which at least contains a color material, to the recording medium by discharging the ink composition through a nozzle orifice in the ink jet head. In the step of applying an ink composition, the ink composition container and the ink composition supply passage having the same configurations as those in the step of applying a reaction liquid can be used. The step of applying an ink composition and the step of applying a reaction liquid may be performed in any order. It is preferable to perform the step of applying a reaction liquid first.

Ink Composition

The ink composition for use in the preset embodiment at least contains a color material, and may contain a resin, a penetrant, a surfactant, a humectant, and/or water according to need. A preferred resin is a resin in the form of fine particles.

Recording Medium

A recording medium that can be used in the present embodiment is, for example, an absorbable or nonabsorbable recording medium.

The absorbable recording medium is not particularly limited. Examples include: plain paper such as electronic photography paper highly penetrable to ink; ink jet paper (paper for ink jet printing that has an ink absorber layer constituted by silica particles or alumina particles or has an ink absorber layer constituted by hydrophilic polymer such as polyvinyl alcohol (PVA) or polyvinylpyrrolidone (PVP)) highly penetrable to ink; and art paper, coated paper, and cast-coated paper for use in usual offset printing, which are relatively poorly penetrable to ink.

The nonabsorbable recording medium is not particularly limited. Examples include: films and plates made of plastics such as polyvinyl chloride, polyethylene, polypropylene, polyethylene terephthalate (PET), polycarbonate, polystyrene, or polyurethane; plates made of metal such as iron, silver, copper, or aluminum; metal plates, plastic films, and alloy plates made of stainless steel or brass or the like which are coated with the above-listed metals by vapor deposition; and recording media constituted by a paper base coated with a film (on which a film is bonded) made of a plastic such as polyvinyl chloride, polyethylene, polypropylene, polyethylene terephthalate (PET), polycarbonate, polystyrene, or polyurethane.

Ink Jet Recording Apparatus

An ink jet recording apparatus of the present embodiment includes: a reaction liquid container for a reaction liquid; and a reaction liquid passage which connects the reaction liquid container to a nozzle orifice in an ink jet head. The reaction liquid contains a (meth)acrylic resin and a polyvalent metal salt. The polyvalent metal salt serves as a coagulating agent that causes coagulation of components of the ink composition. At least one of the materials that constitute the reaction liquid container and the reaction liquid passage and that make contact with the reaction liquid contains a C6 or higher aliphatic acid.

Figure 2:
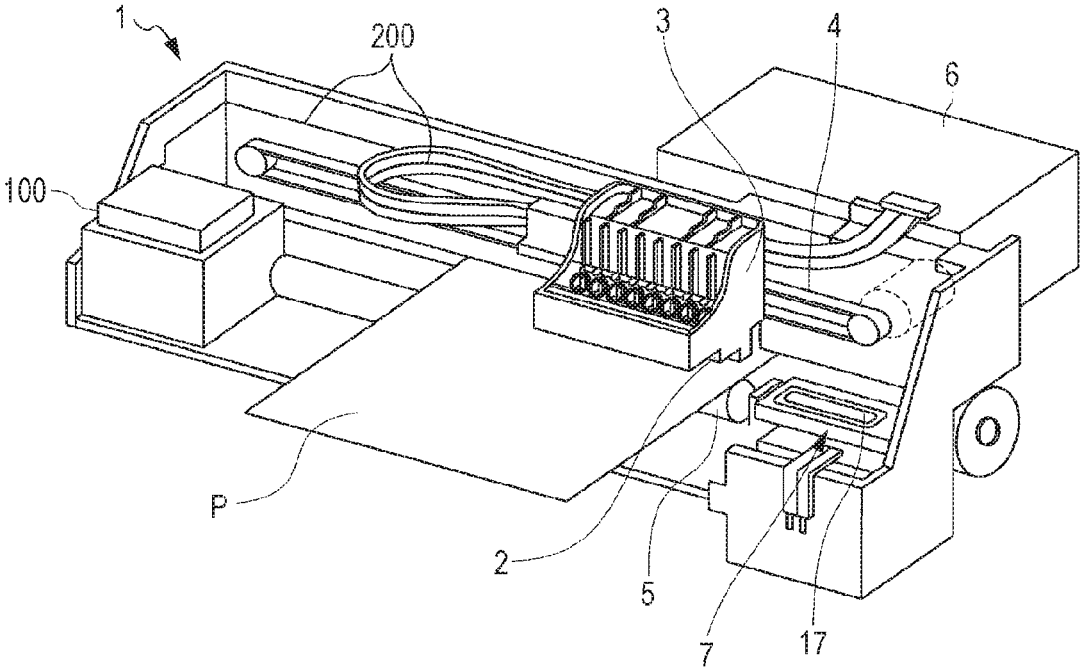
FIG. 2 is a perspective view illustrating a recording apparatus of the present embodiment.

FIG. 2 is a perspective view illustrating a configuration of a recording apparatus (printer 1) of the present embodiment. The printer 1 in FIG. 2 is a serial printer. The serial printer is a printer that includes a carriage configured to travel in a predetermined direction and a head provided on the carriage and that is configured such that droplets are discharged onto a recording medium while the head is travelling with the carriage.

As illustrated in FIG. 2, the printer 1 includes: a carriage 3 having a head 2; a carriage moving mechanism 4 configured to move the carriage 3 in the direction of the width of a recording medium P; and a medium feeding mechanism 5 configured to transport the recording medium P in the forward-backward direction. The printer 1 further has a control section 6 for controlling the operation of the printer 1 as a whole. It should be noted that the direction of the width of the recording medium is the main scanning direction (head scanning direction) and that the forward-backward direction is the subscanning direction (the direction perpendicular to the main scanning direction).

As shown in FIG. 2, the head 2 is connected to, via an ink supply pipe 200 (ink passage), an ink container 100 in which recording ink and replacement ink are separately contained. Either the recording ink or the replacement ink is supplied to the head 2 in accordance with instructions from selecting means.

The printer 1 used in the present embodiment is a so-called "off-carriage" type printer in which the ink container 100 is attached to a housing or the like of the printer 1 and is configured to supply ink to the head 2 through the ink supply pipe 200. Note, however, that this does not imply any limitation. For example, a so-called "on-carriage" type printer in which the ink cartridge is attached to the carriage may be used. Alternatively, a line head printer having no carriages may be used.

The printer 1 further has a home position within the range of travel of the head 2 but outside the area through which the recording medium P passes. The home position serves as the starting point of scanning by the head 2. In the home position, there is a maintenance unit 7 that has a cap.

The maintenance unit 7 is configured to perform humidifying operation, flushing operation, head cleaning operation, and the like. Specifically, the humidifying operation is to suppress drying of nozzle orifices (not illustrated) in the head 2 by capping the head 2 with the cap while no recording operation is performed. The flushing operation is to prevent clogging or the like of the nozzle orifices by discharging the recording ink through the nozzle orifices in the head 2 toward the cap in an auxiliary manner. The head cleaning operation is to, after capping of the head 2 with the cap, replace the recording ink with the replacement ink or replace the replacement ink with the recording ink in the ink passage while discharging the ink through each nozzle orifice by operating a suction pump (not illustrated).

Examples

The following more specifically discusses the invention on the basis of Examples and Comparative Examples. It should be noted that the invention is not intended to be limited in any way by the following Examples.

Ingredients for Reaction Liquid

Coagulating agent: polyvalent metal salt
magnesium acetate (divalent metal salt)
sodium acetate (monovalent metal salt)
(Meth)Acrylic Resin
DISPERBYK-2015 (available from BYK Japan KK, solvent-based)
DISPERBYK-2010 (available from BYK Japan KK, emulsion)
DISPERBYK-2012 (available from BYK Japan KK, solvent-based)
Other
Newcol NT50 (available from Nippon Nyukazai Co, Ltd., polyoxyethylene alkyl ether)
Humectant
propylene glycol Ingredients for Ink Composition Colorant

P.B15:3

Penetrant 1,2-hexanediol

Surfactant

BYK348 (silicone surfactant, available from BYK Japan KK)

Humectant propylene glycol

Preparation of Reaction Liquid and Ink Composition

Ingredients were mixed together in the proportions shown in Tables 1 and 2 below and thoroughly stirred, whereby reaction liquids and ink composition were obtained. It should be noted that the values in Tables 1 and 2 below are in mass % and that the total is 100.0 mass %.

TABLE 1

| composition of reaction liquid | | Reaction liquid 1 | Reaction liquid 2 | Reaction liquid 3 | Reaction liquid 4 | Reaction liquid 5 | Reaction liquid 6 | Reaction liquid 7 | Reaction liquid 8 | Reaction liquid 9 |
|---|---|---|---|---|---|---|---|---|---|---|
| coagulating agent | Mg acetate (divalent metal salt) | 2 | 2 | 2 | 2 | | | 2 | 2 | 2 |
| | Na acetate (monovalent metal salt) | | | | | 2 | 2 | | | |
| (meth)acrylic resin | DISPERBYK-2015 | 0.1 | 10 | 30 | | 10 | | | | |
| | DISPERBYK-2010 | | | | | | | 10 | | |
| | DISPERBYK-2012 | | | | | | | | 10 | |
| surfactant | Newcol N150 | | | | | | | | | 10 |
| humectant | propylene glycol | 20 | 20 | 20 | 20 | 20 | 20 | 20 | 20 | 20 |
| balance | water | up to 100 | up to 100 | up to 100 | up to 100 | up to 100 | up to 100 | up to 100 | up to 100 | up to 100 |
| total | | 100 | 100 | 100 | 100 | 100 | 100 | 100 | 100 | 100 |

TABLE 2

| ink composition | | |
|---|---|---|
| colorant | P.B15:3 | 5 |
| penetrant | 1,2-hexanediol | 5 |
| surfactant | BYK348 | 1 |
| humectant | propylene glycol | 20 |
| balance | water | up to 100 |
| total | | 100 |

Dissolution Amount Test

Test Recording Apparatus 1

A recording apparatus used here was a test recording apparatus 1. Materials that constitute this recording apparatus and that make contact with a reaction liquid were subjected to the foregoing test and the dissolution amount B ($g/cm^2$) of a C6 or higher aliphatic acid was determined.

Next, the total area S, of contact with the reaction liquid, of each material of the test recording apparatus 1 was calculated. Using the dissolution amount B and the total area S, the total dissolution amount M was calculated using the foregoing equation. It should be noted that the reaction liquid container and the reaction liquid passage of the test recording apparatus 1, which make contact with the reaction liquid, are constituted by a single kind of material, i.e., a polyethylene film. The dissolution amount B of a C6 or higher aliphatic acid dissolved from this material was 0.1 ($g/cm^2$) and the total area S was 1.0 $cm^2$. The other materials used here contained no C6 or higher aliphatic acids.

Furthermore, the maximum amount Y (g) of each reaction liquid that can be contained in the reaction liquid container and the reaction liquid passage of the test recording apparatus 1 was calculated. Next, the percentage C (wt %) of the meth(acrylic) resin contained in each reaction liquid was calculated, and the total mass A for each reaction liquid was calculated using the following equation.

$$\text{Total mass } A = Y \times C \times 0.01$$

Test Recording Apparatus 2

The total dissolution amount M for a test recording apparatus 2 was calculated in the same manner as above and found to be 1.0 g. It should be noted that the dissolution amount B of the aliphatic acid dissolved from a polyethylene film constituting the reaction liquid container and the reaction liquid passage, which is one of the materials that constitute the test recording apparatus 2 and that make contact with the reaction liquid, was 1.0 ($g/cm^2$) and the total area S of this polyethylene film was 1.0 $cm^2$. The dissolution amount B of the aliphatic acid dissolved from the other materials was 0.

Furthermore, the maximum amount Y (g) of each reaction liquid that can be contained in the reaction liquid container and the reaction liquid passage of the test recording apparatus 2 was calculated. Next, the percentage C (wt %) of the meth(acrylic) resin contained in each reaction liquid was calculated, and the total mass A for each reaction liquid was calculated using the following equation.

$$\text{Total mass } A = Y \times C \times 0.01$$

Test Recording Apparatus 3

The total dissolution amount M for a test recording apparatus 3 was calculated in the same manner as above and found to be 10.0 g. It should be noted that the dissolution amount B of the aliphatic acid dissolved from a polyethylene film constituting the reaction liquid container and the reaction liquid passage, which is one of the materials that constitute the test recording apparatus 3 and that make contact with the reaction liquid, was 1.0 ($g/cm^2$) and the total area S of this polyethylene film was 10 $cm^2$. The dissolution amount B of the aliphatic acid dissolved from the other materials was 0.

Furthermore, the maximum amount Y (g) of each reaction liquid that can be contained in the reaction liquid container and the reaction liquid passage of the test recording apparatus 3 was calculated. Next, the percentage C (wt %) of the meth(acrylic) resin contained in each reaction liquid was calculated, and the total mass A for each reaction liquid was calculated using the following equation.

$$\text{Total mass } A = Y \times C \times 0.01$$

TABLE 3

| | Ex. 1 R.L. 1 | Ex. 2 R.L. 2 | Ex. 3 R.L. 3 | Ex. 4 R.L. 1 | Ex. 5 R.L. 2 | Ex. 6 R.L. 3 | Com. Ex. 1 R.L. 4 | Com. Ex. 2 R.L. 5 |
|---|---|---|---|---|---|---|---|---|
| acrylic resin content C of reaction liquid (wt %) | 0.1 | 10 | 30 | 0.1 | 10 | 30 | 0 | 10 |
| amount Y of reaction liquid (g) | 1000 | 1000 | 1000 | 2000 | 2000 | 2000 | 2000 | 2000 |
| amount A of acrylic resin (g) | 1 | 100 | 300 | 2 | 200 | 600 | 0 | 200 |
| image quality evaluation | good | good | average | good | good | average | good | poor |
| test recording apparatus 1M = 0.1 g A/M = | 10 | 1000 | 3000 | 20 | 2000 | 6000 | 0 | 2000 |
| filter penetration test | average | good | good | average | good | good | poor | good |
| evaluation of discharge performance | average | good | good | average | good | good | poor | good |
| test recording apparatus 2M = 1.0 g A/M = | 1 | 100 | 300 | 2 | 200 | 600 | 0 | 200 |
| filter penetration test | average | average | good | average | good | good | poor | good |
| evaluation of discharge performance | average | average | good | average | good | good | poor | good |
| test recording apparatus 3M = 10.0 g A/M = | 0.1 | 10 | 30 | 0.2 | 20 | 60 | 0 | 20 |
| filter penetration test | average | average | poor | average | average | average | poor | good |
| Evaluation of discharge performance | average | average | poor | average | average | average | poor | good |

| | Com. Ex. 3 R.L. 6 | Ex. 7 R.L. 1 | Ex. 8 R.L. 2 | Ex. 9 R.L. 3 | Ex. 10 R.L. 7 | Ex. 11 R.L. 8 | Com. Ex. 4 R.L. 9 |
|---|---|---|---|---|---|---|---|
| acrylic resin content C of reaction liquid (wt %) | 0 | 0.1 | 10 | 30 | 10 | 10 | 0 |
| amount Y of reaction liquid (g) | 2000 | 3000 | 3000 | 3000 | 1000 | 1000 | 2000 |
| amount A of acrylic resin (g) | 0 | 3 | 300 | 900 | 100 | 100 | 0 |
| image quality evaluation | poor | good | good | average | good | good | good |
| test recording apparatus 1M = 0.1 g A/M = | 0 | 30 | 3000 | 9000 | 1000 | 1000 | 0 |
| filter penetration test | good | average | good | good | average | good | poor |
| evaluation of discharge performance | good | average | good | good | average | good | poor |
| test recording apparatus 2M = 1.0 g A/M = | 0 | 3 | 300 | 900 | 100 | 100 | 0 |
| filter penetration test | good | average | good | good | average | average | poor |
| evaluation of discharge performance | good | average | good | good | average | average | poor |
| test recording apparatus 3M = 10.0 g A/M = | 0 | 0.3 | 30 | 90 | 10 | 10 | 0 |
| filter penetration test | good | average | average | average | average | average | poor |
| Evaluation of discharge performance | good | average | average | average | average | average | poor |

Note:
Ex. stands for Example
Com. Ex. stands for Comparative Example
R.L. stands for Reaction liquid Durability Test The same polyethylene films as those of the test recording apparatuses (these films are Materials 1 to 3) and the same polyethylene film as Material 1 except that no C6 or higher aliphatic acids are contained (this film is Material 4) were folded in half and straightened repeatedly. The durability of each material (the durability of a material that makes contact with a reaction liquid) was evaluated in accordance with the following evaluation criteria.

good: Film did not become cracked or broken even after 5000 times of folding poor: Film became cracked or broken after less than 5000 times of folding

TABLE 4

| | Material 1 | Material 2 | Material 3 | Material 4 |
|---|---|---|---|---|
| durability test | good | good | good | poor |

Image Quality Evaluation

Image quality was tested with the use of a test recording apparatus. An ink jet printer (PX-G930, available from Seiko Epson Corp., nozzle resolution: 180 dpi, 180 nozzles) was provided with a platen heater, and each reaction liquid was supplied from a pack (a 5 L reaction liquid container) to one nozzle array of an ink jet head through a reaction liquid supply passage. It should be noted here that the materials constituting the reaction liquid container, the reaction liquid supply passage, and the nozzles were the same as those used in the foregoing dissolution amount test.

On the other hand, the ink composition was supplied from an ink pack (ink composition container) to the other nozzle arrays of the ink jet head through an ink composition supply passage. It should be noted that a filter (10 μm mesh) for trapping impurities was disposed between the reaction liquid supply passage and the ink jet head. The reaction liquids and the ink composition used here are shown in Tables 1 and 2.

Then, the reaction liquid was applied onto a recording medium through the head at 720×720 dpi and 0.5 mg/inch$^2$.

The recording medium used here was SY51M (A4 polypropylene film available from UPM RAFLATA) having its recording surface heated to 40° C. After the application of the reaction liquid, the recording medium was transported backward and fed again, and droplets of the ink composition were applied to the same recording area. In this way, an image was recorded. The color ink composition was applied at 720×720 dpi and 5 mg/inch$^2$. After that, the output recording medium was heat-dried at 70° C. for 5 minutes, whereby a recorded product was obtained. It should be noted that the recording medium had a 1 cm margin around its recording area and that the reaction liquid and the ink composition were applied to the entire recording area.

The recorded products thus obtained were visually checked and image quality of them were evaluated in accordance with the following evaluation criteria.

Evaluation Criteria good: There was no bleeding average: There was bleeding poor: There were bleeding and coalescence Evaluation of Discharge Performance With the use of the same test recording apparatus as that used in the image quality evaluation, 3000 g of each reaction liquid was discharged toward an ink receiver through all nozzles in the ink jet head. After discharge, the nozzles were checked whether or not they became totally or partially blocked. The discharge performance was evaluated in accordance with the following evaluation criteria.

Evaluation Criteria good: No nozzles were totally or partially blocked average: Five or less nozzles were totally or partially blocked poor: Six or more nozzles were totally or partially blocked Filter Penetration Test Each reaction liquid was passed through a filter (10 μm mesh, the area that allows passage of liquid is 1 cm$^2$). The amount of the liquid was measured until the filter became clogged and the evaluation was performed in accordance with the following evaluation criteria.

Evaluation Criteria good: No clogging occurred even after passage of 3000 g or more of liquid average: Clogging occurred after passage of 1000 g or more but less than 3000 g of liquid poor: Clogging occurred after passage of less than 1000 g of liquid In Comparative Example 1, in which Reaction liquid 4 containing no (meth)acrylic resins was used, impurities were generated and the results of the filter penetration test and discharge performance evaluation were poor. In Comparative Example 2, in which Reaction liquid 5 containing a monovalent metal salt was used, and in Comparative Example 3, in which Reaction liquid 6 containing no (meth) acrylic resins but containing a monovalent metal salt was used, there was not enough coagulating power and thus bleeding occurred on the obtained recorded products. In Comparative Example 4, in which Reaction liquid 9 containing a surfactant instead of a (meth)acrylic resin was used, impurities were generated and the results of the filter penetration test and discharge performance evaluation were poor.

The entire disclosures of Japanese Patent Application Nos. 2015-103973, filed May 21, 2015 and 2015-139932, filed Jul. 13, 2015 are expressly incorporated by reference herein.

What is claimed is:

1. An ink jet recording method comprising:

applying a reaction liquid to a recording medium by sending the reaction liquid from a reaction liquid container to a nozzle orifice in an ink jet head through a reaction liquid passage and discharging the reaction liquid from the nozzle orifice, the reaction liquid passage connecting the reaction liquid container to the nozzle orifice; and applying a water-based ink composition to the recording medium by discharging the ink composition from a nozzle orifice in the ink jet head, the water-based ink composition containing a colorant, wherein the reaction liquid contains a (meth)acrylic resin and a polyvalent metal salt, the polyvalent metal salt serving as a coagulating agent that is reactive with a component of the water-based ink composition, the (meth)acrylic resin is a colorant dispersant for dispersing the colorant in the water-based ink composition, at least one of materials that constitute the reaction liquid container and the reaction liquid passage and that make contact with the reaction liquid contains a C6 or higher aliphatic acid, and wherein a ratio defined as A/M is 200 or greater, where M is a total amount, in parts by mass, of the aliphatic acid that can be dissolved from the at least one of the materials and A is a total amount, in parts by mass, of the (meth)acrylic resin contained in the reaction liquid in the reaction liquid container and the reaction liquid passage.

2. The ink jet recording method according to claim 1, wherein the aliphatic acid is a C6 to C25 aliphatic acid.

3. An ink jet recording apparatus which is configured to perform recording by the ink jet recording method according to claim 2.

4. The ink jet recording method according to claim 1, wherein the (meth)acrylic resin contains a water-soluble resin.

5. An ink jet recording apparatus which is configured to perform recording by the ink jet recording method according to claim 4.

6. The ink jet recording method according to claim 1, wherein the (meth)acrylic resin is contained in an amount of 0.10 to 20 mass % with respect to a total mass of the reaction liquid.

7. An ink jet recording apparatus which is configured to perform recording by the ink jet recording method according to claim 6.

8. The ink jet recording method according to claim 1, wherein the polyvalent metal salt is contained in an amount of 0.10 to 10 mass % with respect to a total mass of the reaction liquid.

9. An ink jet recording apparatus which is configured to perform recording by the ink jet recording method according to claim 8.

10. An ink jet recording apparatus which is configured to perform recording by the ink jet recording method according to claim 1.

11. The ink jet recording method according to claim 1, wherein the reaction liquid does not contain colorant.

* * * * *